US005505142A

United States Patent [19]

Fink

[11] Patent Number: 5,505,142

[45] Date of Patent: Apr. 9, 1996

[54] LIGHTWEIGHT STACKING TABLE WITH FOLDING LEGS

[76] Inventor: Virginia W. Fink, 45-609 Ha'amaile St., Kaneohe, Hi. 96744

[21] Appl. No.: 251,355

[22] Filed: May 31, 1994

[51] Int. Cl.[6] ..... A47B 3/00

[52] U.S. Cl. ..... 108/129; 108/91

[58] Field of Search ..... 108/91, 92, 129, 108/53.1, 53.3

[56] References Cited

U.S. PATENT DOCUMENTS

| | | | |
|---|---|---|---|
| 2,889,185 | 6/1959 | Heisler | 108/91 |
| 3,271,075 | 9/1966 | Good | 108/129 X |
| 3,747,539 | 7/1973 | Calzaretto | 108/129 X |
| 3,917,108 | 11/1975 | Thurman | 108/53.1 X |
| 4,467,927 | 8/1984 | Nathan | 108/91 X |
| 4,953,973 | 9/1990 | Tomaka et al. | 108/129 X |
| 5,383,411 | 1/1995 | Tomaka et al. | 108/129 |

FOREIGN PATENT DOCUMENTS

| | | | |
|---|---|---|---|
| 303987 | 3/1955 | Switzerland | 108/129 |

*Primary Examiner*—Jose V. Chen
*Attorney, Agent, or Firm*—Donald A. Streck

[57] ABSTRACT

A lightweight stacking table with folding legs. There are a pair of unitary plastic H-shaped legs each having a pair of leg portions separated by a cross-piece. There is a unitary plastic top having a flat top surface and a waffle-patterned under-structure. The under-structure has a pair of mirror imaged H-shaped slots therein holding the pair of H-shaped legs. The top has side edges which angle down and slightly outward from a top edge at the periphery of the top surface and has a curved bottom edge which grips the top edge of a second table when two tables are stacked one upon the other. The H-shaped legs are separately pivotable between stored positions within the H-shaped slots and support positions out of the H-shaped slots supporting the top by four pivot pins through bores in the under-structure and bores top ends of the leg portions.

15 Claims, 3 Drawing Sheets

LIGHTWEIGHT STACKING TABLE WITH FOLDING LEGS

BACKGROUND OF THE INVENTION

This invention relates to tables with folding legs and, more particularly, to a lightweight stacking table with folding legs comprising, four legs; a top having a flat top surface and a waffle-patterned under-structure supporting the top surface, the waffle-patterned under-structure having a plurality of leg-shaped slots therein having respective ones of the four legs disposed therein; and, pivot means for pivotally mounting top ends of the legs in the leg-shaped slots whereby the legs are pivotable between stored positions within the leg-shaped slots and support positions out of the leg-shaped slots and supporting the top.

Tables are not new in the art. Neither are stacking tables, lightweight tables, and tables with folding legs. Yet, within this vast array of prior art, there still exists a need that is not being met. That need is a table that, in one, is lightweight, has folding legs, and is stackable.

For example, York in U.S. Pat. No. 159,737 back in 1875 disclosed a wooden table with folding legs hidden behind a decorative peripheral border piece. Then, in 1882 in U.S. Pat. No. 267,928, Pinckney patented a folding bench, table, and settee, also of wood.

U.S. Pat. No. 1,627,454 by Phalon in 1927 discloses a combined tray and table with folding U-shaped legs similar to the legs of Pinckney.

In 1959, Heisler in U.S. Pat. No. 2,889,185 patented a table stacker plate that is used with the wooden-topped, folding metal legged tables still in common use today at hotels, and the like, to make them stack one upon the other. This type table is the most common type of folding, storable, utility table available today and embodies all the attributes not applicable to the problems the present invention solves. It is heavy. The metal legs and their components rust and the top absorbs moisture, swells, and disintegrates unless the table is kept inside out of the weather.

U.S. Pat. No. 3,747,539 of Calzaretto in 1973 is very similar to the Pinckney and Phalon devices except as to size and use.

The 1988 seed tray support of Chabot (U.S. Pat. No. 4,756,119) is a frame structure with folding legs and having a number of compartments for holding seed trays.

Thorn (U.S. Pat. No. 5,284,100—1994) is an improved metal folding leg system for the standard temporary banquet type table wherein the Heisler table stacker plate discussed above was employed. A table using the folding leg system of Thorn has all the same limitations as the prior art tables of similar construction—heavy weight and lack of weather resistance.

When working with small children in schools, preschools, day care centers, and the like, tables are a necessity. They must be light enough in weight that the teachers (and even the small children) can move them about easily without danger of injury. Yet, they must be strong enough that a child can stand and jump on them without any structural failure that can result in injury to the child. They must be stackable for storage and movement in cars or vans; yet, must be secure in their stacking such that the stack will not easily fall over and cause possible injury. They must be washable. And, if left out in the weather, they must not rust or fall apart. Moreover, since most agencies involved with the need are on severe budgets, they must be simple and inexpensive to build.

Despite the long time availability of strong, lightweight, waterproof plastics, nobody in the prior art has made a table with the required features. Thus, to provide for her own need for such a table, the inventor herein invented what the prior art has failed to invent despite the longtime need and availability of the various prior art.

Wherefore, it is the object of this invention to provide a table that has foldable legs, is stackable, light weight, sturdy, weather-proof, and inexpensive to build.

Other objects and benefits of this invention will become apparent from the description which follows hereinafter when read in conjunction with the drawing figures which accompany it.

SUMMARY

The foregoing object has been attained by the lightweight stacking table with folding legs of the present invention comprising, four legs; a top having a flat top surface and a waffle-patterned under-structure supporting the top surface, the waffle-patterned under-structure having leg-shaped slots therein having respective ones of the four legs disposed therein, the top having side edges which angle down towards the waffle-patterned under-structure and slightly outward from a top edge at the periphery of the top surface and have a curved bottom edge which grips the top edge of a second table when two tables are stacked one upon the other; and, pivot means for pivotally mounting top ends of the legs in the leg-shaped slots whereby the legs are pivotable between stored positions within the leg-shaped slots and support positions out of the leg-shaped slots and supporting the top.

Preferably, the four legs comprise a pair of integral leg members each having a pair of connected leg portions; the waffle-patterned under-structure has a pair of mirror image integral leg member-shaped slots therein having respective ones of the pair of leg members disposed therein; and, the pivot means pivotally mounts top ends of the leg portions in the slots whereby the pair of leg members are separately pivotable between the stored positions and the support positions.

More preferably, each of the pair of leg members is H-shaped and comprises a pair of the leg portions separated and connected by a cross member.

The preferred pivot means comprises four pivot pins disposed in transverse bores through the waffle-patterned under-structure and top ends of the leg portions.

To prevent loss of spilled liquids or rollable items from the table top, the top edge may be configured as a raised ridge.

DESCRIPTION OF THE PREFERRED EMBODIMENT

Figure 1:
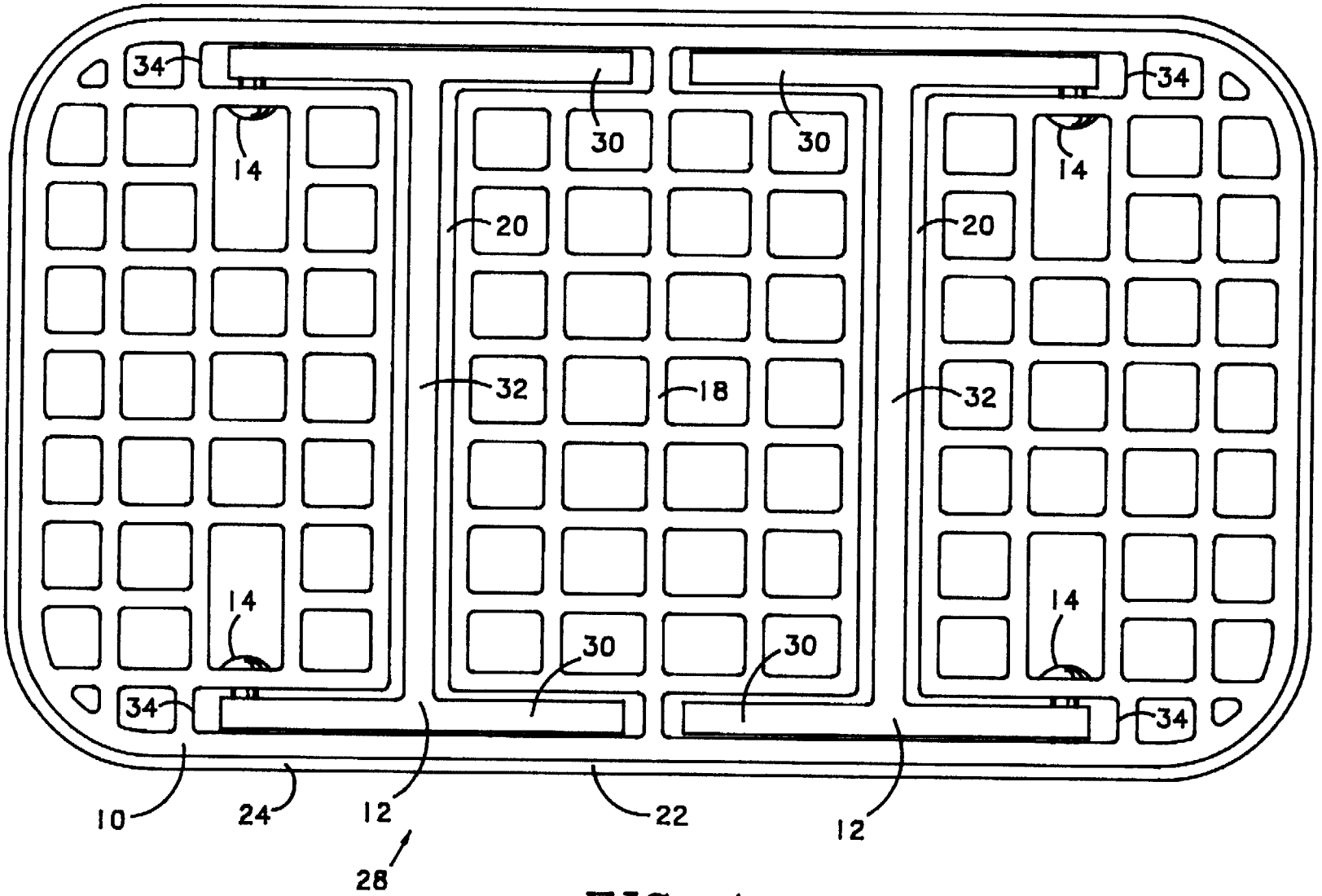
FIG. 1 is a bottom view of a table according to the present invention with both legs folded.
Figure 2:
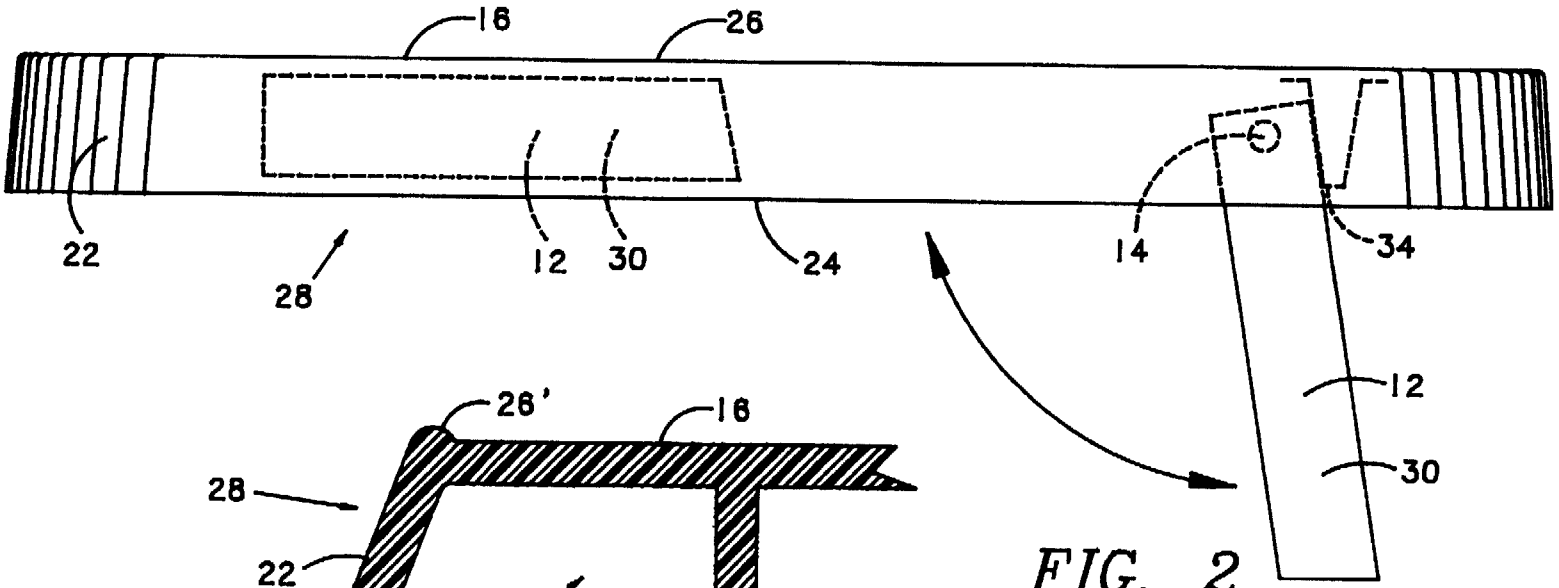
FIG. 2 is a side view of a table according to the present invention with one leg folded and one leg in its supporting position.

As shown in the drawing figures, the present invention in its preferred embodiment is composed of three parts of injection molded plastic. There is one top 10, two H-shaped legs 12, and four pivot pins 14. The top 10 has a flat top surface 16 and a waffle-patterned under-structure 18 supporting the top surface 16. As used herein, the term "waffle-patterned" simply means that there are a plurality of vertical members separated by space that provides a strong structure with minimum weight as employed in so-called "hollow core" doors, and the like, well known to those of ordinary skill in the art. As best seen in FIG. 1, the under-structure 18 includes a pair of mirror image H-shaped slots 20 formed therein for receiving the H-shaped legs 12 when they are in their folded position.

Figure 7:
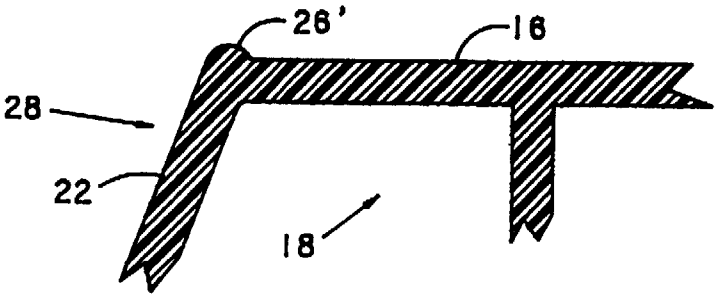
FIG. 7 is an enlarged side view of one corner of a table according to the present invention wherein the table top edge is a raised ridge to prevent articles and liquids from going over the edge.
Figure 3:
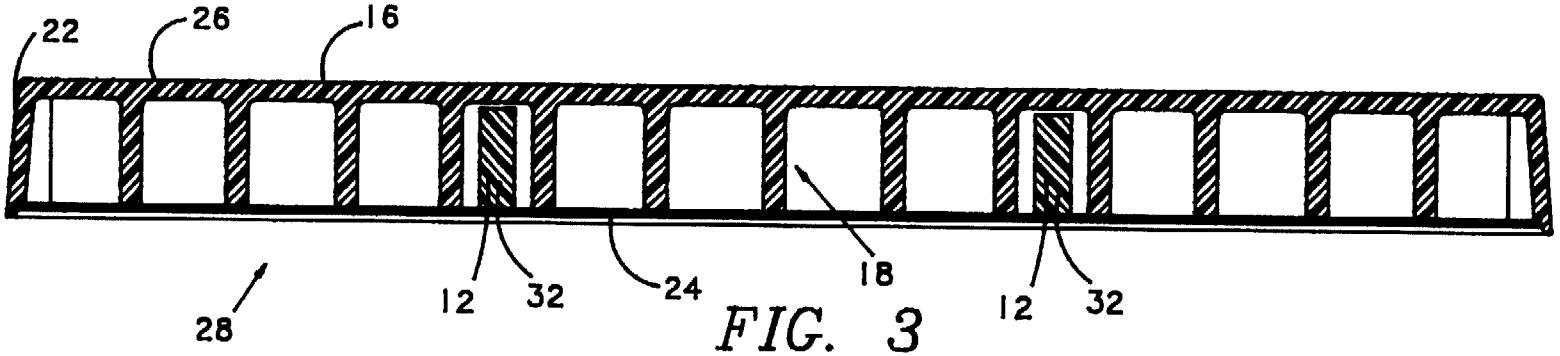
FIG. 3 is a cutaway side view through a middle portion of the table of the present invention with both legs folded.
Figure 4:
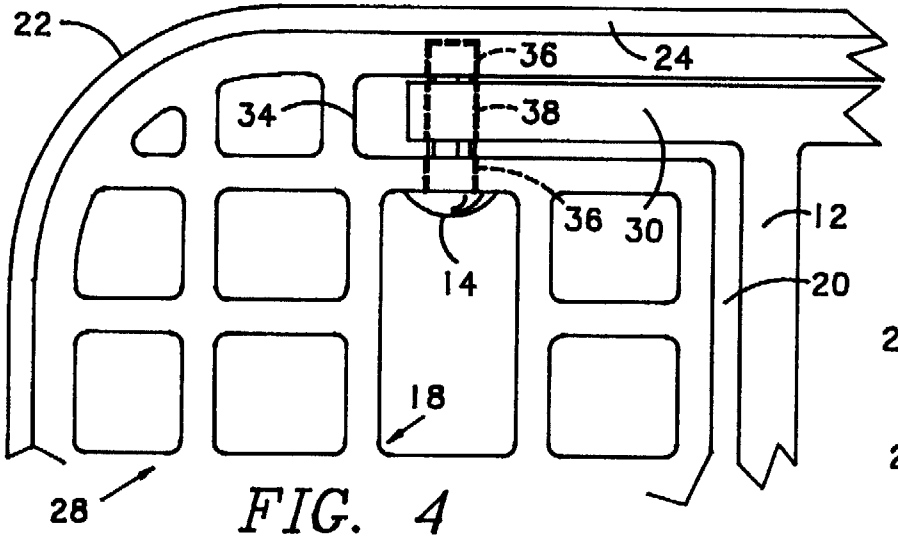
FIG. 4 is an enlarged view of one corner of the bottom of the table of the present invention showing the leg pivot pin in its installed position.
Figure 5:
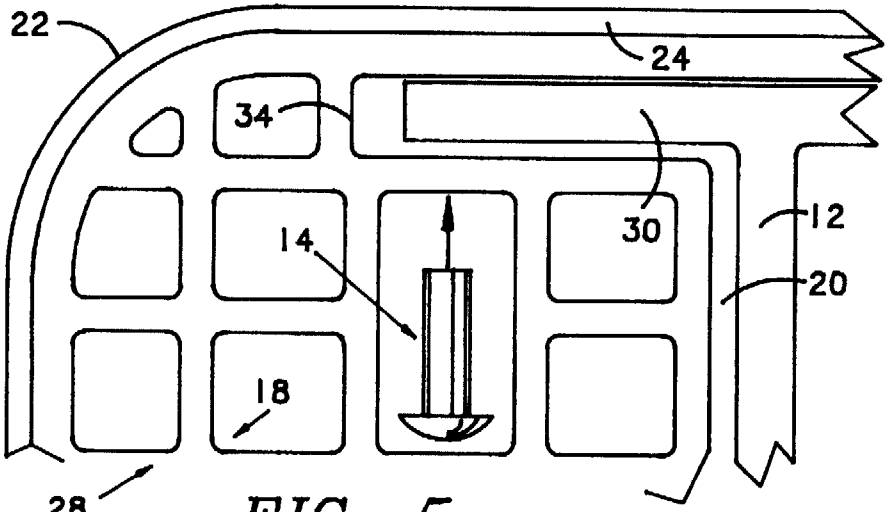
FIG. 5 is an enlarged view of one corner of the bottom of the table of the present invention showing the leg pivot pin being inserted to its installed position.
Figure 6:
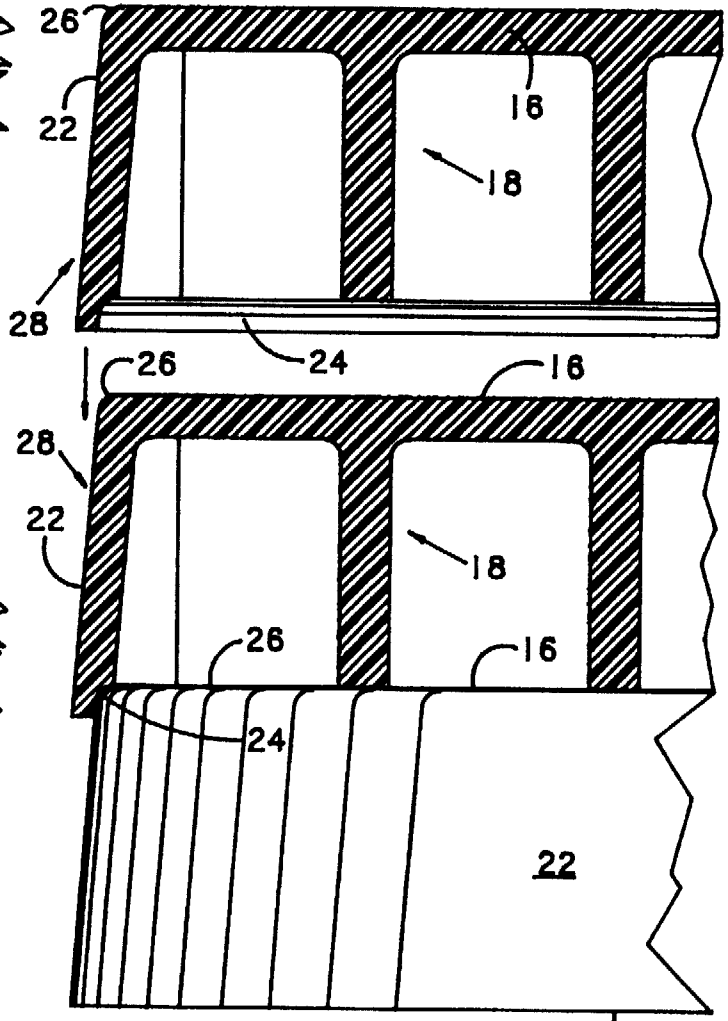
FIG. 6 is an enlarged side view of one corner of three tables according to the present invention with two shown cutaway so as to demonstrate how the tables of the present invention securely stack one upon the other.

The side edges 22 of the top 10 angle down towards the waffle-patterned under-structure 18 and slightly outward from the top surface 16 and have a curved bottom edge 24 as best seen in FIG. 6 which grips the top edge 26 at the periphery of the top surface 16. Thus, with the H-shaped legs 12 in their respective H-shaped slots 20, the tables 28 stack securely one upon the other as depicted in FIG. 6. If desired, the top edge 26' at the periphery of the top surface 16 can be raised and rounded into a ridge that is gripped by the curved bottom edge 24 as depicted in FIG. 7. This configuration is preferred for use with small children to contain spilled liquids and prevent crayons, and the like, from rolling off the edge.

While four individual legs, X-shaped legs, or such, could be employed and are considered as being within the scope and spirit of the present invention, the two H-shaped legs 12 are preferred for a number of reasons. As an integral piece, the two leg portions 30 and the cross-piece 32 are much sturdier and there are no joints to break or come apart. By pivoting over center and then being supported against further movement by portions of the waffle-patterned under-structure 18 acting as stops 34, the legs are quite securely braced. Likewise, while other pivoting mechanism could be employed and are considered as being within the scope and spirit of the present invention, the use of the heavy duty plastic pivot pins 14 as shown is preferred. The pins 14 are easily inserted into concentric bores 36 and 38 in the waffle-patterned under-structure 18 and the top ends of the leg portions 30 provided for the purpose. A little plastic glue in the bores 36 before insertion of the pins 14 assures their secure retention therein. Moreover, as those of ordinary skill in the art will recognize, this approach means that the manufacturer does not have to do any assembly. This "some assembly required" approach cuts down dramatically on manufacturing costs as the manufacturer simply boxes the plastic components and the consumer does the assembly.

It should also be noted that by making the H-shaped slots 20 in the under-structure 18 with bottom portions sized to received the longest legs available, various sizes of the H-shaped legs 12 can be employed with a common top 10. Thus, the tables of the present invention can be stocked as components to be chosen and assembled by the user to suit their particular needs while, at the same time, reducing the inventory requirements of the retailer.

Thus, it can be seen from the foregoing description and the drawing figures accompanying it that the present invention has truly met its stated objectives by providing a table unlike any thing shown or suggested by the prior art despite the long-time need therefore that is simple, lightweight, strong, stackable, with folding legs, weather-proof, and cheap to build.

Wherefore, having thus described the present invention, what is claimed is:

1. A lightweight stacking table with folding legs comprising:

a) four legs each being generally planar along a length thereof in one lateral direction and having a shape in a second lateral direction orthogonal to said one lateral direction;

b) a top having a flat top surface and a waffle-patterned under-structure supporting said top surface, said waffle-patterned under-structure having a plurality of slots therein in said shape of and having respective ones of said four legs disposed therein; and, c) pivot means for pivotally mounting top ends of said legs in ends of said slots in said second lateral direction whereby said legs are pivotable in said one lateral direction between stored positions within said slots and support positions out of said slots and supporting said top.

2. The lightweight stacking table with folding legs of claim 1 wherein:

a) said four legs comprise a pair of integral leg members each having a pair of connected leg portions;

b) said slots being a pair of mirror image integral leg member-shaped slots having respective ones of said pair of leg members disposed therein; and, c) said pivot means pivotally mounts top ends of said leg portions in said slots whereby said pair of leg members are separately pivotable between said stored positions and said support positions.

3. The lightweight stacking table with folding legs of claim 2 wherein:

each of said pair of leg members is H-shaped and comprises a pair of said leg portions separated and connected by a cross member.

4. The lightweight stacking table with folding legs of claim 2 wherein:

said pivot means comprises four pivot pins disposed in transverse bores through said waffle-patterned under-structure and top ends of said leg portions.

5. The lightweight stacking table with folding legs of claim 1 wherein:

said top has side edges which angle down towards said waffle-patterned under-structure and slightly outward from a top edge at the periphery of said top surface and have a curved bottom edge which grips said top edge of a second table when two tables are stacked one upon the other.

6. The lightweight stacking table with folding legs of claim 5 wherein:

said top edge is a raised ridge.

7. A lightweight stacking table with folding legs comprising:

a) four legs each being generally planar along a length thereof in one lateral direction and having a shape in a second lateral direction orthogonal to said one lateral direction;

b) a top having a flat top surface and a waffle-patterned under-structure supporting said top surface, said waffle-patterned under-structure having a plurality of slots therein in said shape of and having respective ones of said four legs disposed therein, said top having side edges which angle down towards said waffle-patterned under-structure and slightly outward from a top edge at the periphery of said top surface and have a curved bottom edge which grips said top edge of a second table when two tables are stacked one upon the other; and, c) pivot means for pivotally mounting top ends of said legs in ends of said slots in said second lateral direction whereby said legs are pivotable in said one lateral direction between stored positions within said slots and support positions out of said slots and supporting said top.

8. The lightweight stacking table with folding legs of claim 7 wherein:

a) said four legs comprise a pair of integral leg members each having a pair of connected leg portions;

b) said slots being a pair of mirror image integral leg member-shaped slots having respective ones of said pair of leg members disposed therein; and, c) said pivot means pivotally mounts top ends of said leg portions in said slots whereby said pair of leg members are separately pivotable between said stored positions and said support positions.

9. The lightweight stacking table with folding legs of claim 8 wherein:

each of said pair of leg members is H-shaped and comprises a pair of said leg portions separated and connected by a cross member.

10. The lightweight stacking table with folding legs of claim 8 wherein:

said pivot means comprises four pivot pins disposed in transverse bores through said waffle-patterned under-structure and top ends of said leg portions.

11. The lightweight stacking table with folding legs of claim 7 wherein:

said top edge is a raised ridge.

12. A lightweight stacking table with folding legs comprising:

a) a pair of integral leg members each having a pair of connected leg portions each of said pair of integral leg members being generally planar along a length thereof in one lateral direction and having a shape in a second lateral direction orthogonal to said one lateral direction;;

b) a top having a flat top surface and a waffle-patterned under-structure supporting said top surface, said waffle-patterned under-structure having a pair of mirror image integral slots therein in said shape of and having respective ones of said pair of leg members disposed therein, said top having side edges which angle down towards said waffle-patterned under-structure and slightly outward from a top edge at the periphery of said top surface and have a curved bottom edge which grips said top edge of a second table when two tables are stacked one upon the other; and, c) pivot means for pivotally mounting top ends of said leg portions in ends of said slots in said second lateral direction whereby said pair of leg members are separately pivotable in said one lateral direction between stored positions within said slots and support positions out of said slots and supporting said top.

13. The lightweight stacking table with folding legs of claim 12 wherein:

each of said pair of leg members is H-shaped and comprises a pair of said leg portions separated and connected by a cross member.

14. The lightweight stacking table with folding legs of claim 12 wherein:

said pivot means comprises four pivot pins disposed in transverse bores through said waffle-patterned under-structure and top ends of said leg portions.

15. The lightweight stacking table with folding legs of claim 12 wherein:

said top edge is a raised ridge.

* * * * *